United States Patent [19]

Coggiola

[11] 4,017,988

[45] Apr. 19, 1977

[54] SELF-CLEANING STEAM IRON

[75] Inventor: James P. Coggiola, Pomona, Calif.

[73] Assignee: General Electric Company, Bridgeport, Conn.

[22] Filed: Apr. 7, 1976

[21] Appl. No.: 674,636

[52] U.S. Cl. ..... 38/77.83

[51] Int. Cl.[2] ..... D06F 75/06

[58] Field of Search ..... 38/77.83, 77.5, 77.7, 38/77.8, 77.81

[56] References Cited

UNITED STATES PATENTS

| | | | |
|---|---|---|---|
| 3,694,942 | 10/1972 | Vondracek et al. | 38/77.83 |
| 3,747,241 | 7/1973 | Davidson | 38/77.83 |
| 3,823,498 | 7/1974 | Davidson et al. | 38/77.83 |

*Primary Examiner*—Patrick D. Lawson
*Attorney, Agent, or Firm*—John F. Cullen; George R. Powers; Leonard J. Platt

[57] ABSTRACT

A self-cleaning steam iron with steam control means, a fill opening to an interior water tank, a ported soleplate and a steam generating boiler and coverplate with distribution passages therebetween and having means to purge the iron of water and residues including a substantially large opening in the tank with means operable to control the opening to suddenly dump and conduct the water directly into the boiler. To this general arrangement the invention provides an improvement comprising a boiler which has at least a pair of separate symmetrical legs extending toward the rear of the iron with each leg having outlet means preferably on the outer peripheral side of the leg and extending substantially over the entire outside of each leg, the outlet means communicating with the soleplate ports so the tank water may be suddenly dumped directly into the boiler to traverse the entire boiler rearwardly through each leg and then through the outlet toward the soleplate periphery and through the port means to scrub the entire boiler clear of deposits.

4 Claims, 3 Drawing Figures

SELF-CLEANING STEAM IRON

BACKGROUND OF THE INVENTION

1. Field of the Invention

The invention herein pertains to a steam iron and, more particularly, to a self-cleaning steam iron which employs a substantially large opening in the tank so that it may be suddenly emptied directly into the steam boiler which is suitably formed so that the water traverses the entire boiler rearwardly through a pair of legs to clean the boiler of all deposits.

2. Description of the Prior Art

The present invention is an improved version of the boiler dump self-cleaning iron of U.S. Pat. No. 3,823,498 which, in turn, was an improvement of the basic self-cleaning iron of U.S. Pat. No. 3,747,241 both of common assignment. Both patents disclose the concept of suddenly dumping the water tank to create a large mass of steam to clean the passages of the iron. The irons that use water for either steam or spray or both, a water tank is provided above the soleplate and a conventional water valve provides controlled and metered water drippage into a steam boiler where it flashes to steam and is directed out ports in the soleplate to steam the article. Powered or manual spray attachments have been added to irons to supply a fine spray of water to the fabric. Generally distilled water is required in steam irons because of the fineness of the various water passages and orifices subject to clogging due to mineral deposits from the water which deposits vary from one locality to another. Also, the steam ports in the soleplate collect lint from the ironing operation and some of this may find it way into the internal passage structure when the iron is up-ended and not in use. Hard tap water contains minerals which produce loose flakes of varying sizes and deposits that plate out on the iron components and clogs the fine passages. These generally consist of lime or calcium carbonate as well as other chemicals in solution in the water or they may be in relatively large flake form in the water and the deposits may vary around the country. Screens may clear the passageways and some constructions provide brushes or other cleaning implements and still others dump water into supplementary boiler systems to create extra steam and pump it through the iron. Until the U.S. Pat. No. 3,747,241 above, prior art constructions have not provided a self-cleaning iron wherein the tank and passages may be substantially completely cleaned by dumping the water onto the hot soleplate to blow out all the impurities in a simple operation in which the entire iron is purged at the end of the ironing session. The U.S. Pat. No. 3,823,498 invention improved on that basic self-cleaning function by dumping the water directly into the boiler of the iron where a scrubbing action is generated to clean the boiler of the iron as well as other passages. The present invention improves on the boiler dump U.S. Pat. No. 3,823,498 invention by particularly forming the steam generating boiler to provide a flow-thru action whereby water dumped into the boiler flows completely through it into a pair of rearwardly extending legs and thence out the soleplate ports to flush the entire boiler to remove lint and mineral deposits from the boiler and steam vents including all deposits that settle out when the iron is upended in storage position.

SUMMARY OF THE INVENTION

Briefly, described, the present invention is directed to a steam iron with steam control means and a fill opening to an interior water tank, a soleplate with ports, and a steam generating boiler and coverplate thereover with steam distribution passages therebetween. The iron is purged of water and loose residues by including a substantially large opening in the tank with means operable to control the opening to suddenly dump the water into the boiler. In this generally known arrangement, the cleaning operation is much improved by providing the boiler with at least a pair of separate symmetrical legs extending towards the rear of the iron, each leg having outlet means extending substantially over the entire outside of the leg and communicating with the soleplate ports. Additionally, an opening is provided in the coverplate between the boiler and tank which opening overlaps the boiler edges in the soleplate so the suddenly dumped water is dumped directly into the boiler scrubbing the sides of the boiler and then traversing the entire boiler rearwardly through each leg and out towards the soleplate periphery substantially along the entire length of the leg and out the ports enabling the entire boiler cavity to be completely flushed including the flushing of any desposits collecting the upright heel position. Thus, the main object of the invention is to improve on the boiler dump concept of the U.S. Pat. No. 3.823,498 and improve the boiler scrubbing action to better and more completely flush out the boiler for a thorough and additional cleaning action.

DESCRIPTION OF THE PREFERRED EMBODIMENT

The invention is described for convenience on a manual spray flash boiler steam iron although it is also applicable to flooded boiler types shown in U.S. Pat. No. 3,156,054 of common assignment. The invention discloses a self-cleaning iron, where, on pushing a button, the water tank is suddenly emptied directly into the steam boiler and the suddenly generated steam forces substantially all loose mineral deposits from the iron. This is the concept of U.S. Pat. No. 3,747.241 as improved by U.S. Pat. No. 3,823,498 of common assignment. The suddenly generated steam forces the loose deposits out the soleplate ports and this is the intent of "purge" or "self-cleaning" and the like as used herein. The present invention is a specific improvement on said U.S. Pat. No. 3,823,498 in the formation and arrangement of the boiler structure in a general combination to provide a more complete and effective purge of the iron.

Figure 1:
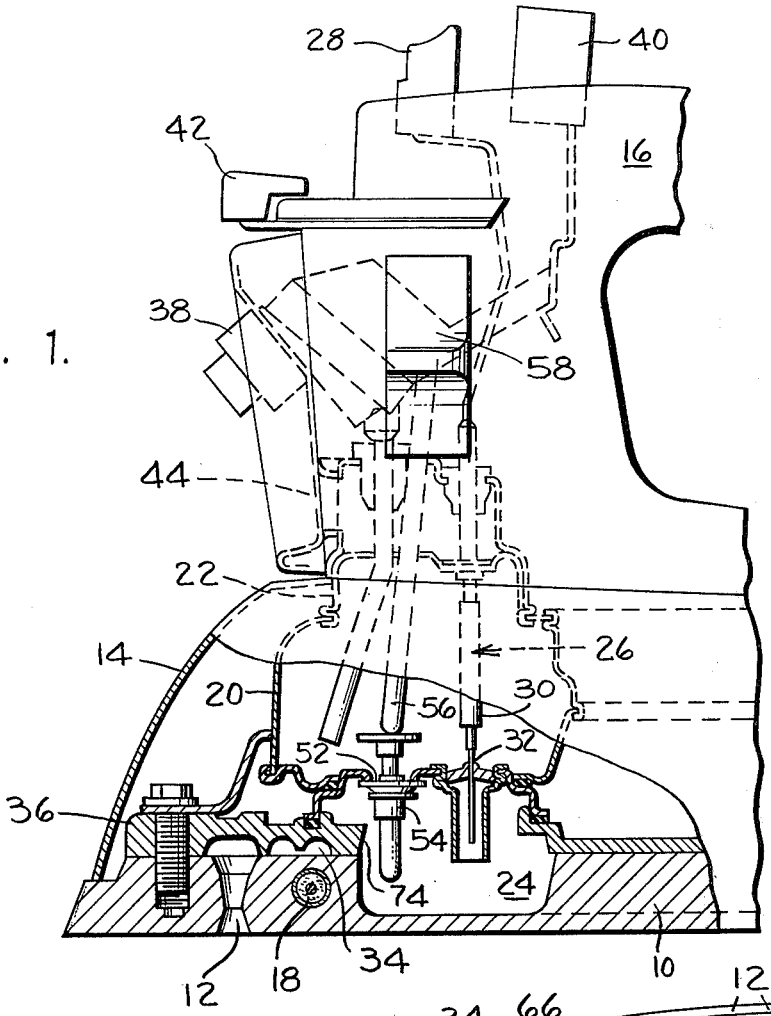
FIG. 1 is an elevational view, partially in section and broken away, showing general parts of a manual spray steam iron with the invention applied.

Referring to FIG. 1, there is shown a steam iron that includes soleplate 10 having plural steam ports 12 and outer shell 14 connected to handle 16 all in known fashion. The soleplate may be wrought or preferably cast aluminum with electrical heating element 18 cast in position. The heating element is the sheathed type extending in a loop beginning at the rear of the iron along one side to the forward end and then rearwardly along the other side in a conventional manner for uniform heat distribution to the soleplate.

The iron includes steam generating means by providing interior water tank 20 which may have a vertical outer suitably shaped riser tube means 22 in the forward portion for housing various operating mechanisms. For steam, soleplate 10 has a steam generating boiler 24 to receive metered water. The water is started and stopped for controlling steam generation by water valve structure generally indicated at 26 and activated by steam control means such as button 28 and connected spring-biased vertical stem 30. Water is metered through orifice 32 from tank 20 into boiler 24, the resulting steam being distributed and directed through distribution passages 34, under coverplate 36, and out the ports 12 onto the fabric being ironed. If desired, a spray attachment 38 may be operated by control button 40 and may be manual as shown or power, both well known in the art. Temperature control 42 operates a thermostat to control the heat generated in the soleplate. In order to supply water to the tank 20 for steam and/or spray, fill opening 44 communicates directly with the water tank interior. When the iron is steaming with button 28 in the "up for steam" position as shown in FIG. 1, water is metered to boiler 24 where flash steam is generated to find its way into distributing passages 34 and thence out soleplate ports 12 in a known manner. The iron is operable either non-pressurized as described or may use a pressurized system as described in said U.S. Pat. No. 3,823,498.

As described in said patent, it is unnecessary any longer to turn the iron nose down to drain water out fill opening 44 to empty tank 20 because the iron is self-cleaning and draining. This is because means is present to conduct the entire tank contents directly into the boiler by providing the bottom of tank 20 with a substantially large opening 52 that may be spaced and separate from the usual metering orifice 32. Many equivalent forms may be used to provide the large opening, such as a concentric annulus around the metering orifice 32 or any other functional equivalent. This opening is thus defined as "substantially large" that may be spaced and separate but need not be and is intended to include any additional unrestricted flow opening that rapidly empties the tank and functions other than as the small restrictive flow metering orifice. This is in the form of any large spaced opening that, as shown in the drawings, preferably but not necessarily, is separate and therefore is, in effect, a plugged hole in the bottom of the water tank 20 to rapidly dump the tank. The opening 52 is controlled by valve 54 which may be spring-biased closed and actuated by a suitable stem 56 and dump button 58 on the side of the handle. Depressing button 58 opens valve 54 dumping all the water from tank 20 directly into boiler 24. The sudden surge of water hitting the hot soleplate creates a large quantity of steam which is directed and used to purge and self-clean the iron.

Figure 2:
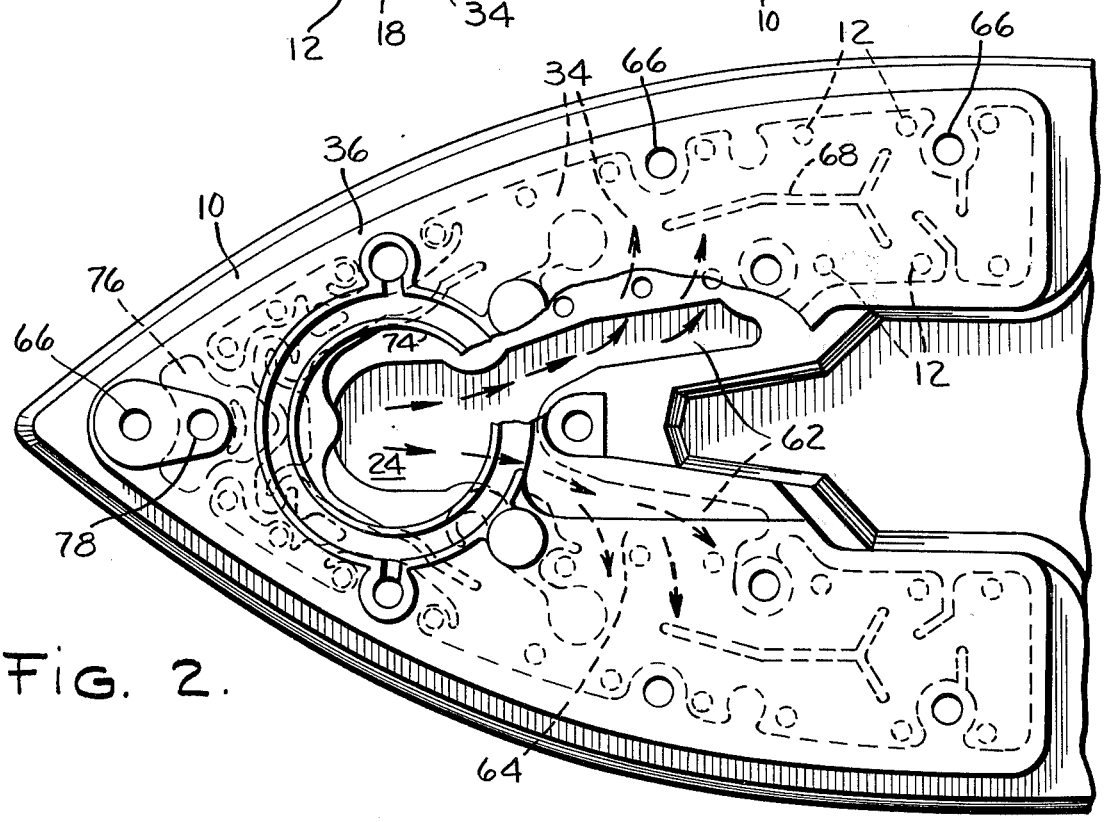
FIG. 2 is a plan view of the iron coverplate on a soleplate partly broken away to show the boiler leg structure, and showing the steam distribution passages between the cover and soleplate.

The structure thus far described is shown in said U.S. Pat. No. 3,823,498 and the present invention is an improvement on the boiler scrubbing arrangement of said patent. It should be understood, the various passages, while shown primarily in the coverplate herein, may be in the soleplate. To this end, the boiler in soleplate 10 is formed of the "wishbone" type which, per se, is generally known as shown in FIG. 2 of U.S. Pat. No. 3,919,793 of common assignment and in FIG. 2 herein. As such, it has a pair of separate symmetrical legs 62 extending towards the rear of the iron for a substantial distance as shown. The use of separate symmetrical legs provides a narrowed portion for increasing steam velocity as the steam is squeezed from boiler 24 into the narrower extending legs 62. In order for the steam to exit the iron, each leg is provided with an extending outlet means 64 formed in the adjacent coverplate 36 that, with soleplate 10, forms steam distribution passages 34 that direct the steam through ports 12 in the conventional manner. To secure the coverplate 36 and soleplate 10 together, multiple screw holes 66 are provided throughout the coverplate, and steam directing ribs 68 are suitably disposed to spread the steam throughout the entire soleplate. The particular distributing passages, except as tied to the extending legs 62, are conventional and may take many forms as best determined by the heat distributing characteristics desired.

Figure 3:
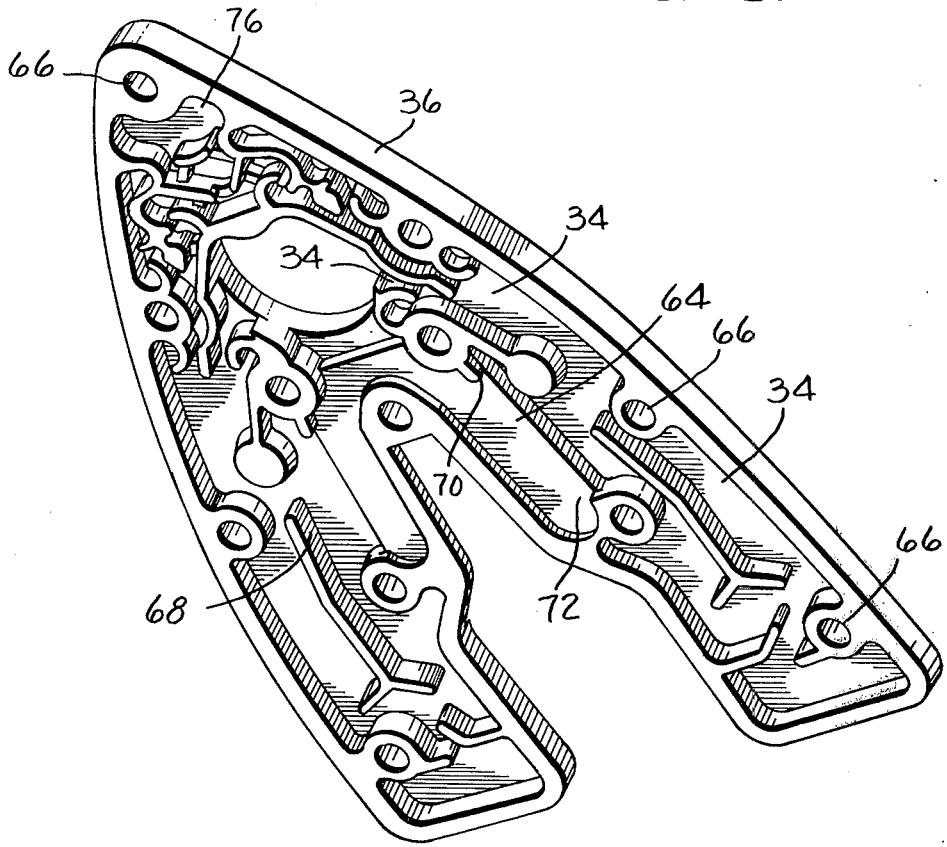
FIG. 3 is a perspective view of the undersurface of the coverplate.

In order to carry off the steam rapidly and permit it to reach the extreme ends of legs 62 to sweep out all deposits therein, the outlet means 64 is disposed on one side of each leg to extend substantially over the entire outside of the leg from 70 to 72 as shown in FIG. 3. This long outlet means on the outside of the legs directs the dump water/steam towards the soleplate periphery from each leg and directly into the distributing passages 34 and out the ports 12.

For a more complete scrubbing action in the boiler 24 itself, the means that conducts the water directly from the tank into the boiler includes a second opening 74 disposed in the coverplate between the boiler and tank opening 52 and this opening 74 is disposed directly below the tank opening 52 and is designed to be larger or overlap the boiler edges as shown in FIG. 2 so that the dumped water scrubs all sides of the boiler before exiting downstream through the leg outlet means 62 in the direction of the arrows.

Summarized, the water empties from tank 20 directly into large opening 74 in the coverplate and into the elongated boiler 24 with the overlapping ensuring that the water dumps directly on the sides of the boiler to scrub them and the flash steam then races down the extending legs 62 through elongated outlets 64 completely scrubbing and purging the entire boiler cavity. There is no reverse flow but merely a straight-through scrubbing action. When the iron is on its heel rest in storage position, any loose deposits naturally fall by gravity into the lower ends of extending legs 62. The subsequent purging and scrubbing action with large outlet means 64 completely scrub out the collected debris at the lower ends of legs 62 to provide a thorough cleaning.

The arrangement described permits standardization of parts in numerous irons and a common soleplate and coverplate may be used for steam irons as well as steam irons with extra surge capacity and spray. To this end, the coverplate and soleplate may be provided with additional passage and steam generating means as shown in the forward end in FIG. 2 comprising an additional generating chamber 76 which may become usable if casting hole 78 in the coverplate is drilled out. Of course, additional structure is needed to direct a separate quantity of water into generator 76 for the additional surge of steam and subsequent distribution to soleplate port 12 in much the manner described for a separate surge system shown in FIG. 3 of said U.S. Pat. No. 3,919,793. As such, it forms no part of the present invention except to illustrate that standard parts may be used to provide surge capacity or no surge capacity depending on whether hole 78 is drilled through coverplate 36 in order to use the additional structure in the coverplate/soleplate. In either case, the self-cleaning action is enhanced and improved over the boiler dump action in the U.S. Pat. No. 3,823,498 by means of the "wishbone" extending legs and elongated side openings directing the steam to the soleplate periphery as described and claimed herein.

While there has been described a preferred form of the invention, obvious equivalent variations are possible in light of the above teachings. It is therefore to be understood that, within the scope of the appended claims, the invention may be practiced otherwise than as specifically described, and the claims are intended to cover such equivalent variations.

I claim:

1. In a steam iron having steam control means, a fill opening to an interior water tank, a soleplate with ports, a steam generating boiler and coverplate thereover with steam distribution passages therebetween, and means to purge the iron of water and loose residues including a substantially large first opening in said tank with means operable to control said opening to suddenly dump the water and means conducting the water directly into said boiler, the improvement comprising, said boiler having at least a pair of separate symmetrical legs extending towards the rear of said iron, each said leg having outlet means extending substantially over the entire one side thereof and communicating with said ports, whereby the tank water may be suddenly dumped directly into the boiler to traverse the entire boiler rearwardly through each leg and then through the outlet means to said ports to scrub the entire boiler clear of deposits.

2. Apparatus as described in claim 1 wherein said conducting means to the boiler includes, a second opening in the coverplate between the boiler and tank large opening, said second opening being disposed directly below the tank large opening and overlapping the boiler edges, so the dumped water scrubs the sides of the boiler before exiting said leg outlet means

3. Apparatus as described in claim 1 wherein the outlet means is disposed on the outside of said legs to direct the dumped water towards the soleplate periphery from each leg.

4. Apparatus as described in claim 2 wherein the outlet means extends substantially over the entire outside of said legs to direct the dumped water towards the soleplate periphery from each leg and then out said ports.

* * * * *